United States Patent [19]

Ross

[11] 3,949,482

[45] Apr. 13, 1976

[54] GUN SIGHT AND METHOD OF MAKING THE SAME

[75] Inventor: Cecil Jack Ross, El Paso, Tex.

[73] Assignee: W. R. Weaver Company, El Paso, Tex.

[22] Filed: Aug. 25, 1975

[21] Appl. No.: 607,089

[52] U.S. Cl. ..... 33/241; 356/247
[51] Int. Cl.[2] ..... F41G 1/32; G02B 27/32
[58] Field of Search ..... 33/241; 356/247

[56] References Cited

UNITED STATES PATENTS

| | | | |
|---|---|---|---|
| 2,472,809 | 6/1949 | Decker | 33/241 |
| 2,706,335 | 4/1955 | Munsey | 33/241 |
| 3,362,074 | 1/1968 | Luebkeman et al. | 356/247 |
| 3,700,339 | 10/1972 | Steck | 33/241 |
| 3,912,400 | 10/1975 | Luebkeman | 33/241 |

*Primary Examiner*—Samuel B. Rothberg
*Assistant Examiner*—Steven L. Stephan
*Attorney, Agent, or Firm*—Donald R. Motsko; H. Samuel Kieser; William W. Jones

[57] ABSTRACT

A collimated gun sight having a fluorescently illuminated reticle. The sight is contained in a single tube and is sized so as to be capable of being mounted on the muzzle of a gun.

4 Claims, 3 Drawing Figures

GUN SIGHT AND METHOD OF MAKING THE SAME

This invention relates to a gun sight having a collimated image of the reticle and a fluorescent light source which is housed in a single tube. The sight is sized for mounting on the muzzle of a gun.

The gun sight of this invention is an improvement in the type of sight disclosed in U.S. Pat. No. 3,700,339 issued Oct. 24, 1972 to William F. Steck, III. The sight disclosed in the referenced patent is composed of several components which are housed in a single tube sized for mounting on the muzzle of a gun. The sight disclosed in the referenced patent is, however, time consuming and tedious to assemble as its component parts must be separately pressed or glued in place in the tube.

The sight of this invention is characterized by its ease of assembly and includes an opague tubular housing having an internal through bore of predetermined diameter. The wall of the housing is crimped radially inwardly at a point proximate to one end of the housing to form a localized reduction in the housing bore. The housing has an opening cut through its wall adjacent to the crimp to form a window through which ambient surrounding light may pass. A reticle illuminator in the form of a cylindrical rod of fluorescent plastic is positioned inside of the housing. The illuminator rod has an outside diameter which is slightly smaller than the diameter of the housing bore. The illuminator rod is positioned to underlie the window so that ambient light can enter the illuminator rod through its side wall and be emitted through its end walls. A diaphragm member is positioned next to one end wall of the illuminator inside of the tubular housing. The diaphragm is in the form of a disk having an opening therethrough defining a reticle. The outside diameter of the diaphragm is slightly smaller than the diameter of the housing bore. A spacer tube having a through bore is positioned next to the diaphragm. The spacer has an outside diameter which is slightly less than the diameter of the housing bore. A collimating lens is positioned next to the spacer and is focussed on the reticle-forming opening in the diaphragm to provide a collimated image of the reticle. The length of the spacer is equal to the focal length of the collimating lens so as to ensure that the latter is focussed on the reticle. The outside diameter of the collimating lens is slightly less than the diameter of the housing bore. A cylindrical retaining ring is press-fitted into the housing bore and engages the lens to hold all of the elements in place within the housing.

It is, therefore, an object of this invention to provide a gun sight having a collimated reticle image which is contained in a single tubular housing and which is sized for mounting on the muzzle end of a gun.

It is a further object of this invention to provide a gun sight of the character described having a plurality of internal components which can be quickly positioned inside of the housing to greatly simplify assembly.

It is yet another object of this invention to provide a method for making a gun sight of the character described.

These and other objects and advantages of the invention will become more readily apparent from the following detailed description of a preferred embodiment thereof taken in conjunction with the accompanying drawings, in which.

Figure 1:
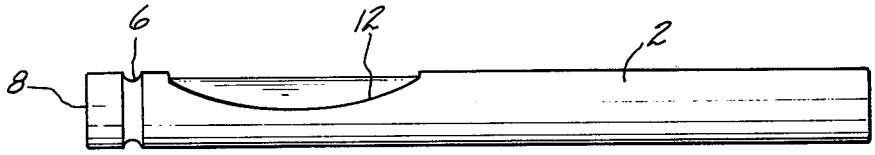
FIG. 1 is a side elevational view of a preferred embodiment of a gun sight formed in accordance with this invention.
Figure 2:
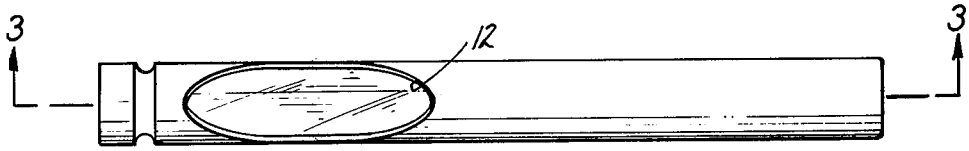
FIG. 2 is a top plan view of the gun sight of FIG. 1.

Referring now to the drawings, the gun sight of this invention includes a single tubular housing 2 which is preferably formed from seamless steel tubing and is sized to be mountable on the muzzle of a firearm. The housing has an outside diameter preferably about 0.160 in. and an axial through bore 4 having about a 0.140 in. diameter. A circumferential crimp 6 is formed in the housing wall near the forward end 8 thereof to form a localized reduction in the diameter of the housing bore 4 at 10. A generally oval-shaped slot 12 is cut through the housing wall rearwardly of the crimp 6 to form a window through which ambient surrounding light may pass.

Figure 3:
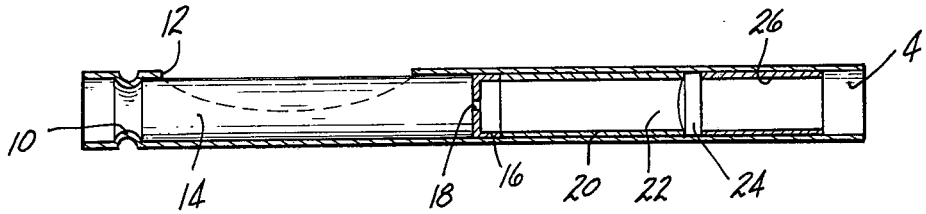
FIG. 3 is an axial sectional view of the gun sight taken along lines 3—3 of FIG. 2.

Referring now particularly to FIG. 3, there are shown the internal components of the sight which form a stack of abutting elements within the housing bore 4. These components include a cylindrical rod 14 made of fluorescent plastic material. The rod 14 serves as a reticle illuminator and is positioned in the housing tube bore 4 with one end of the rod 14 engaging the bore reduction 10 to be held thereby against falling out of the front end 8 of the tube 2. The side wall of the rod 14 underlies the tube slot 12 so as to be exposed to ambient light passing through the slot 12. The ambient light striking the rod side wall is absorbed by the rod, fluoresced and transmitted to the end walls of the rod from which it is emitted in a known manner. The outside diameter of the rod 14 is made slightly smaller than the diameter of the tube bore 4 so that the rod 14 can be easily slid into the bore 4.

Adjacent to the rear end wall of the rod 14 there is positioned a reticle-forming member 16 which may take the form of a cup or disk. The member 16 has a small axial opening 18 formed therein which passes emitted fluorescent light from the rod 14 rearwardly through the tube bore 4. The opening 18 forms the reticle of the sight. The outside diameter of the member 16 is made slightly smaller than the tube bore diameter so that the member 16 can be easily inserted and positioned in the tube bore 4.

Adjacent to the rear end of the reticle-forming member 16 is a spacer sleeve 20. The sleeve 20 is an elongated hollow open-ended cylinder which has an outside diameter made slightly smaller than the diameter of the tube bore 4 so as to be freely insertable and slidable therein, and an internal through passage 22 for transmission of the illuminated reticle image.

Adjacent to the rearward end of the spacer sleeve 20 is a collimating lens 24 which is focussed on the opening 18 to form a collimate image of the reticle which is transmitted to the rear toward the eye of the viewer. The length of the spacer sleeve 20 is controlled so as to ensure that the lens 24 will be properly focussed on the opening 18 when the lens 24 is in abutment with the rear end of the spacer sleeve 20. The outside diameter of the lens 24 is made slightly smaller than the diameter of the tube bore 4 so as to be freely insertable and slidable therein.

Adjacent to the rearward end of the lens 24 is an assembly retaining ring 26 which engages the rear face of the lens 24 and is press fitted into the tube bore 4 so as to be retained securely therein by friction.

It will be appreciated that each of the internal components of the sight, except for the retaining ring 26, is freely slidable in the sight tube and are kept from falling out of the tube 2 in one direction by the crimp 6 and in the other direction by the retaining ring 26.

The sight is assembled easily by taking the tubular housing with crimp 6 and slot 12 formed therein and orienting the empty housing with the crimped end down. The illuminator rod 14, reticle-forming member 16, spacer sleeve 20, and lens 24 are then merely dropped into the tube 2, the crimp 6 serving to prevent them from passing completely through the tube. The retaining ring 26 is then pressed into place and assembly is complete. With this simplified construction all critical spacing of elements within the tube is taken care of by the dimensions of the elements themselves, no difficult spacing or gluing is necessary, and assembly can be completed in a matter of about 15 seconds.

It will be readily appreciated that the gun sight construction of this invention readily lends itself to mass production of the sight along with simple, quick assembly. The use of adhesives to hold the several components in place in the sight tube may be omitted and proper spacing of the sight elements is accomplished by controlling their dimensions and having them all abut each other within the tube.

Since many changes and variations of the disclosed embodiment of the invention may be made without departing from the inventive concept, it is not intended to limit the invention otherwise than as required by the appended claims.

What is claimed is:

1. A gun sight adapted to be mounted on the muzzle end of a gun, said sight comprising:

a. a single opaque tubular housing having a through bore of predetermined diameter;

b. a slot through a side wall of said housing forming a window for the passage of ambient light therethrough;

c. first means forming a localized reduction in the diameter of said through bore adjacent to one end of said housing;

d. a stack of internal components contained within said housing bore with each of said components having a generally circular outer wall of a diameter which is less than the diameter of said housing through bore to permit free passage of each of said components through said through bore, said components comprising in series:

i. a cylindrical rod of fluorescent plastic material serving as a reticle illuminator and underlying said window;

ii. reticle-forming means adjacent to said rod and abutting one end wall thereof and including a light transmitting passage forming a reticle for the sight and positioned to transmit fluorescent light from said rod;

iii. at least one spacer sleeve adjacent to said reticle-forming means and abutting one end wall thereof; and iv. collimating lens means adjacent said spacer sleeve and abutting one end wall thereof to provide a collimated image of said reticle; and e. a retaining ring press-fitted into the end of said housing bore remote from said first means, said first means engaging one end of said stack to hold said components against passage through said one end of said housing bore, and said retaining ring engaging the other end of said stack to hold said components against passage through the other end of said housing bore.

2. The gun sight of claim 1, wherein said first means is a circumferential crimp formed in the wall of said housing.

3. The gun sight of claim 1, wherein said spacer sleeve is formed with a longitudinal dimension which ensures focussing of said collimating lens on said reticle.

4. A method of forming a gun sight comprising the steps of:

a. providing a hollow tubular housing having an open-ended through bore and a slot forming a window in the wall of said housing;

b. forming a circumferential crimp in said housing wall adjacent one end thereof;

c. inserting into the other end of said housing bore a plurality of internal sight components comprising in series: an illuminating rod; a reticle-forming member; a spacer sleeve; and a collimating lens focussed on said reticle-forming member; to form a stack of said components with each of said components in said stack abutting an adjacent one of said components, with one end of said stack abutting said crimp to prevent said stack from passing completely through said housing bore; and d. inserting a retainer sleeve into said one end of said housing bore into snug frictional engagement therewith and into abutment with the other end of said stack to retain said stack in said housing bore.

* * * * *